United States Patent [19]

Winkelman

[11] Patent Number: 4,913,446

[45] Date of Patent: Apr. 3, 1990

[54] TRADING GAME AND METHOD FOR CONTINUING PLAYING

[76] Inventor: Martha Winkelman, 9195 Collins Ave., Apt. 6-6, Surfside, Fla. 33154

[21] Appl. No.: 887,908

[22] Filed: Jul. 21, 1986

[51] Int. Cl.[4] ..... A63F 3/00

[52] U.S. Cl. ..... 273/240; 273/278

[58] Field of Search ..... 273/278, 256

[56] References Cited

U.S. PATENT DOCUMENTS

| | | | |
|---|---|---|---|
| 2,691,528 | 10/1954 | Laidlaw | 273/256 |
| 3,237,948 | 3/1966 | Murray | 273/256 |
| 3,499,646 | 3/1970 | Burgess | 273/278 |
| 3,539,189 | 11/1970 | Shelton | 273/256 |
| 3,799,552 | 3/1974 | Lefevre et al. | 273/256 |
| 4,378,942 | 4/1983 | Isaac | 273/278 |

*Primary Examiner*—Edward M. Coven
*Assistant Examiner*—Benjamin Layno

[57] ABSTRACT

The preferred embodiment of this invention features a trading game in which some or all of the activities, features and events related to a stock exchange or the like, may be simulated for the enjoyment of 2 or more players. The game consists of 5 sessions and 3 steps in each session and it is played on a simple game board characterized by providing a distinct trading symbol in each of the playing spaces therein, for the players to select at least one trading symbol per turn to conduct simulated trading transactions. The value of the simulated investments represented therein are subject to change during the game and at game-end, the player accumulating the most play money over his/her start up funds, wins the game. This invention also provides a method of continuing playing, thereby linking together the 5 sessions game with a plurality of succeeding completed 5 sessions games. The game closes after every 5 sessions game and re-opens to run continuously over an undetermined period of time. The game may be played by up to a large and varying group of players. Each participant plays and finish his/her own game independently from each other. The player achieving the largest score on record is the current champion until another player betters this record score. A former player may better his/her previous score as a new player. The 5 sessions game may be played with or without employing the method of continuing playing.

28 Claims, 6 Drawing Sheets

FIG. 3
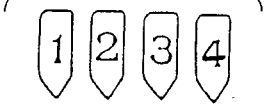
FIG. 2
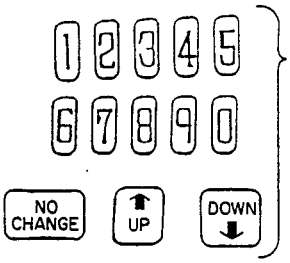
FIG. 5
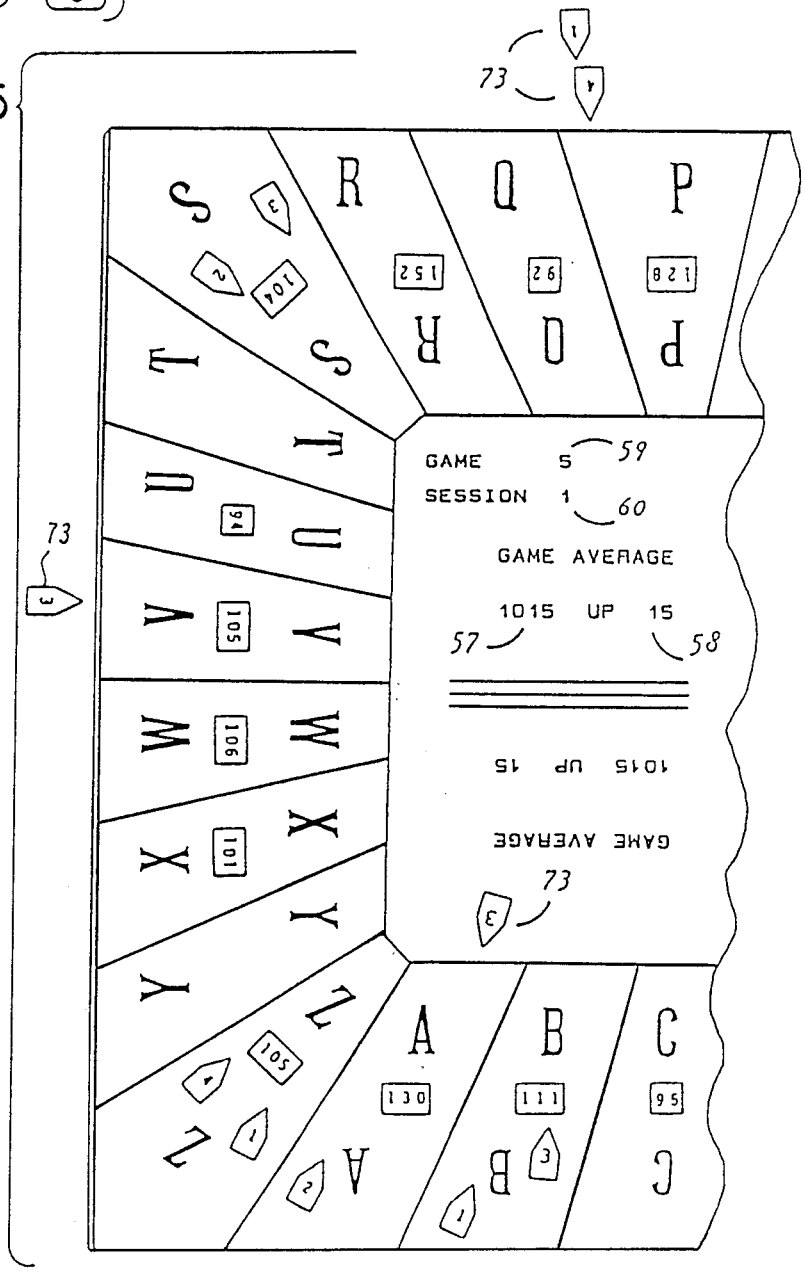
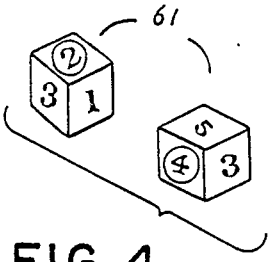
FIG. 4
FIG. 6D
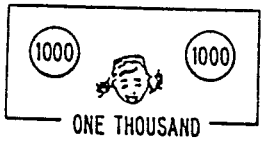

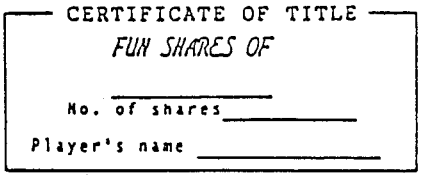
FIG. 6A
FIG. 6H
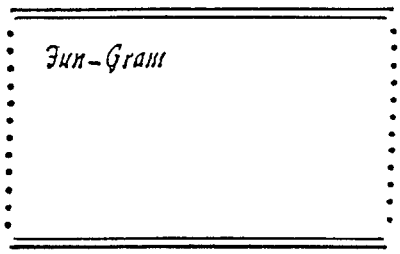
FIG. 6B
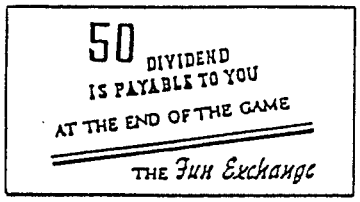
FIG. 6C
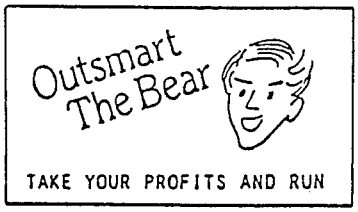
FIG. 6F
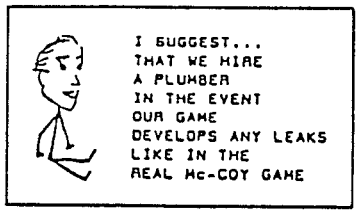
FIG. 6I
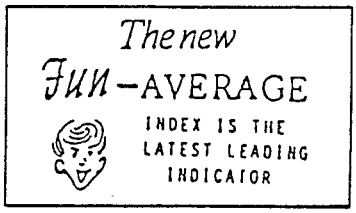
FIG. 6E
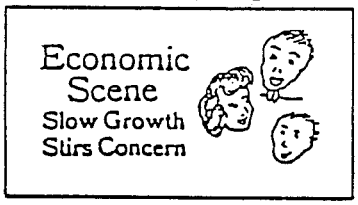
FIG. 6G
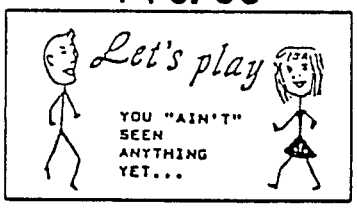
FIG. 6J
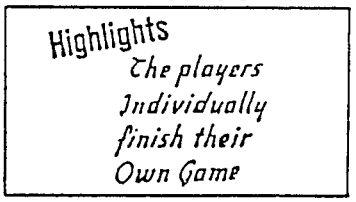
FIG. 7
WORK SHEET
| TRADING SYMBOLS | 62 TRADING SESSION 1 Qty | PRICE | 63 2 Qty. | PRICE | 64 3 Qty. | PRICE | 65 4 Qty. | PRICE | 66 5 Qty. | PRICE |
|---|---|---|---|---|---|---|---|---|---|---|
| A | 1 | 100 | | | | | | | | |
| B | | | | | | | | | | |
| C | | | | | | | | | | |
| D | | | | | | | | | | |
| E | | | | | | | | | | |
| F | | | | | 1 | 110 | | | | |
| G | | | | | | | 2 | 105 | (1) | 110 |
| H | | | | | | | | | | |
| I | | | | | | | | | | |
| J | | | | | | | | | | |
| K | | | | | (1) | 120 | | | | |
| L | | | | | | | | | | |
| M | | | | | | | | | | |
| N | 1 | 100 | | | | | | | (1) | 110 |
| O | | | | | | | | | | |
| P | | | | | | | | | | |
| Q | | | | | | | | | | |
| R | | | | | | | | | | |
| S | | | 2 | 105 | | | | | | |
| T | | | | | | | | | | |
| U | | | | | | | | | | |
| V | | | | | | | | | | |
| W | | | | | | | | | | |
| X | | | | | | | | | | |
| Y | | | | | | | | | | |
| Z | | | | | | | | | | |

FIG. 8A

GAME NO. ____ Quotations Record

| TRADING SYMBOLS | TRADING SESSION 1 | 2 | 3 | 4 | 5 | CLOSE | CHANGE PLUS | MINUS |
|---|---|---|---|---|---|---|---|---|
| A | 100 | 105 | 102 | 106 | 112 | 112 | + 12 | |
| B | 100 | 95 | 90 | 93 | 95 | 100 | ... | ... |
| C | 100 | | | 105 | 106 | 106 | + 6 | |
| D | 100 | 109 | 105 | 102 | 100 | 95 | | - 5 |
| E | 100 | | | | | 100 | ... | ... |
| F | 100 | 100 | 103 | 100 | 105 | 103 | + 3 | |
| G | 100 | 98 | 96 | 101 | 103 | 105 | + 5 | |
| H | 100 | | | | 98 | 98 | | - 2 |
| I | 100 | 105 | 108 | 110 | 106 | 105 | + 5 | |
| J | 100 | | | | | 100 | ... | ... |
| K | 100 | 95 | 100 | 105 | 104 | 105 | + 5 | |
| L | 100 | | | | 105 | 101 | + 1 | |
| M | 100 | 94 | 101 | 107 | 95 | 94 | | - 6 |
| N | 100 | | | | | 100 | ... | ... |
| O | 100 | 98 | 97 | 99 | 105 | 110 | + 10 | |
| P | 100 | 100 | 110 | 98 | 99 | 98 | | - 2 |
| Q | 100 | 99 | 101 | 105 | 103 | 100 | ... | |
| R | 100 | | | | | 100 | ... | ... |
| S | 100 | | | | | 100 | ... | ... |
| T | 100 | 99 | 98 | 95 | 96 | 92 | | - 8 |
| U | 100 | 101 | 106 | 108 | 112 | 108 | + 8 | |
| V | 100 | | | | | 100 | ... | ... |
| W | 100 | 101 | 100 | 101 | 100 | 101 | + 1 | |
| X | 100 | 99 | 98 | 99 | 100 | 100 | ... | ... |
| Y | 100 | | | 99 | 100 | 101 | + 1 | |
| Z | 100 | 101 | 102 | 103 | 104 | 105 | + 5 | |

84 84 85 86 87 88 89 90

FIG. 9

ORDER FORM

| TRADING SYMBOLS | PURCHASES QTY. | PRICE | AMOUNT | SALES QTY. | PRICE | AMOUNT |
|---|---|---|---|---|---|---|
| | 75 | 76 | 77 | 78 | 79 | 80 |
| A | | x | | | x | |
| B | | x | | | x | |
| C | | x | | 20 | x 110 | 2,200 |
| D | | x | | | x | |
| E | | x | | | x | |
| F | | x | | | x | |
| G | 50 | x 95 | 4,750 | | x | |
| H | | x | | | x | |
| I | | x | | | x | |
| J | | x | | | x | |
| K | 10 | x 105 | 1,050 | | x | |
| L | | x | | | x | |
| M | | x | | | x | |
| N | | x | | | x | |
| O | | x | | | x | |
| P | | x | | | x | |
| Q | | x | | | x | |
| R | | x | | | x | |
| S | | x | | 20 | x 120 | 2,400 |
| T | | x | | | x | |
| U | | x | | | x | |
| V | | x | | | x | |
| W | | x | | | x | |
| X | | x | | | x | |
| Y | | x | | | x | |
| Z | | x | | | x | |
| 81 | TOTAL | $ 5,800 | | TOTAL | $ 4,600 | 82 |
| 83 | COMMISSION $ 40 | | | | | |

FIG. 8B

GAME CHAMPIONSHIP RECORD

| DATE | CHAMPION'S NAME | GAME NO. | SCORE |
|---|---|---|---|
| | | | |
| | | | |
| | | | |

FIG. 8C

GAME AVERAGE

| TRADING SYMBOLS | QUOTATION OPEN | CLOSE | CHANGE | |
|---|---|---|---|---|
| | 50 | 52 | 53 | |
| A | 100 | 130 | + 30 | 54 |
| E | 100 | 100 | ... | |
| I | 100 | 88 | - 12 | 55 |
| O | 100 | 103 | + 3 | 54 |
| U | 100 | 94 | - 6 | 55 |
| | | TOTAL CHANGE | + 15 | 56 |

OPEN 1000 CHANGE + 15 CLOSE 1015

51 58 57

FIG. 10B
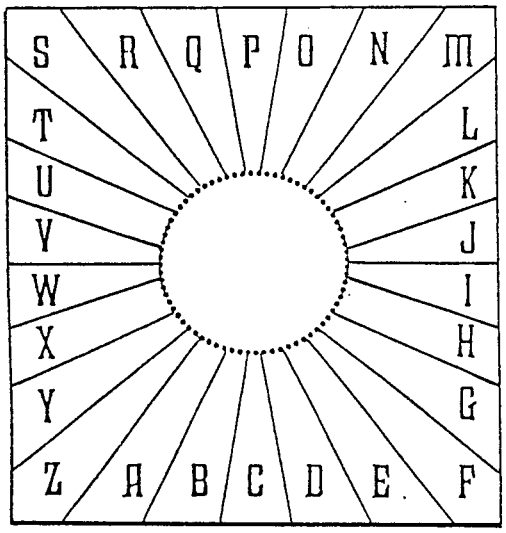
FIG. 10
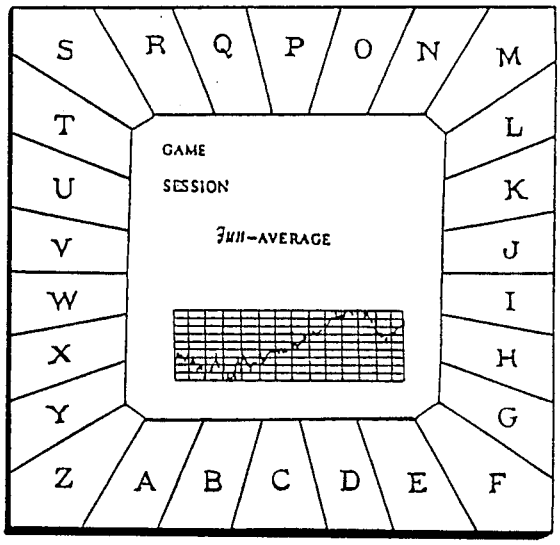
FIG. 11
Game Score
| 94 TRADING SYMBOLS | 95 QTY. CARRIED OVER | 96 TRADING SESSION 1 | 97 2 | 98 3 | 99 4 | 100 5 | 101 CLOSE QTY. | | 102 PRICE | 103 PORTFOLIO REGULAR TRADING | 104 "SHORT" TRADING |
|---|---|---|---|---|---|---|---|---|---|---|---|
| A | | | | | | | | x | | | |
| 109 B | | | 10 | (10) | | | | x | | | |
| C | | | | | | | | x | | | |
| D | | | | | | | | x | | | |
| 110 E | 60 | 50 | | | | | 110 | x | 115 | 12,650 | |
| F | | | | | | | | x | | | |
| 111 G | 50 | | | (50) | | | | x | | | |
| H | | | | | | | | x | | | |
| 112 I | 20 | | | (20) | | 50 | 50 | x | 130 | 6,500 | |
| J | | | | | | | | x | | | |
| 113 K | 100 | 50 | | | | | 150 | x | 110 | 16,500 | |
| L | | | | | | | | x | | | |
| M | | | | | | | | x | | | |
| 114 N | (10) | | | | (10) | | (20) | x | 105 | | 2,100 |
| O | | | | | | | | x | | | |
| 115 P | (100) | | | | 50 | | (50) | x | 120 | | 6,000 |
| 116 Q | (10) | | | | | | (10) | x | 115 | | 1,150 |
| R | | | | | | | | x | | | |
| 117 S | 60 | | 90 | 20 | | (50) | 120 | x | 100 | 12,000 | |
| T | | | | | | | | x | | | |
| 118 U | | | | | 40 | | 40 | x | 90 | 3,600 | |
| V | | | | | | | | x | | | |
| 119 W | 20 | | | | | | 20 | x | 100 | 2,000 | |
| Y | | | | | | | | x | | | |
| Z | | | | | | | | x | | | |
105 — REGULAR TRADING $53,250
106 — "SHORT" TRADING $9,250

FIG. 12

CUMULATIVE RECORD

PLAYER'S NAME _____ GAME No. _____ DATE _____

| TRADING SESSION | PURCHASES | SALES |
|---|---|---|
| 1 | 12,500 | |
| 2 | | 15,000 |
| 3 | 10,000 | |
| 4 | 15,000 | |
| 5 | 12,500 | |
| THIS GAME 6 PURCHASES $ | 50,000 | |
| 7 SALES | | $ 15,000 |

| COMMISSION | |
|---|---|
| 8 CARRIED OVER | 320 |
| 9 THIS GAME | 110 |
| 10 CUMULATIVE COMMISSION $ | 430 |

| PURCHASES | |
|---|---|
| 11 CARRIED OVER | 235,000 |
| 12 THIS GAME (line 6) | 50,000 |
| 13 CUMULATIVE PURCHASES $ | 285,000 |

| SALES | |
|---|---|
| 14 CARRIED OVER | 45,000 |
| 15 THIS GAME (line 7) | 15,000 |
| 16 CUMULATIVE SALES $ | 60,000 |

| CREDITS | |
|---|---|
| 17 CARRIED OVER | 460 |
| 18 THIS GAME | 100 |
| 19 CUMULATIVE CREDITS $ | 560 |

| | | CHARGES | CREDITS |
|---|---|---|---|
| 20 | CUMULATIVE PURCHASES (line 13) | 285,000 | |
| 21 | CUMULATIVE SALES (line 16) | | 60,000 |
| 22 | CUMULATIVE COMMISSIONS (line 10) | 430 | |
| 23 | CUMULATIVE CREDITS (line 19) | | 560 |
| | YOUR INVESTMENT MARKET VALUE | | |
| 24 | ASSETS (regular trading) | | 290,000 |
| 25 | LIABILITIES (short trading) | 30,000 | |
| 26 | TOTAL CHARGES | $ 315,430 | |
| 27 | TOTAL CREDITS | | $ 350,560 |
| 28 | CREDITS (line 27) | 350,560 | |
| 29 | LESS CHARGES (line 26) | 315,430 | |
| 30 | YOUR PAPER SCORE | $ 35,130 | |

TRADING GAME AND METHOD FOR CONTINUING PLAYING

BRIEF SUMMARY OF THE INVENTION

This invention relates to a board game, and more particularly to a trading game in which diversified business and financial transactions involving chance and skill elements are simulated for the enjoyment of 2 or more players.

The invention is susceptible for practice in a variety of themes by making some adaptations of the preferred embodiment without departing from the scope of the invention, and thereby provide a competitive, interesting and challenging pastime.

A trading game based upon tangible properties, such as a bycicle, toys, other things, and intangible properties such as stocks and bonds, other investments appear best suitable for the theme and practice of this invention.

Accordingly, a trading game simulating a stock exchange or the like and also, a method of continuing playing have been fully developed for illustration herein of the preferred embodiment of this invention.

The game is provided and equipped to be played "with or without" employing the method of continuing playing.

The game of this invention offers a different advantage over the prior art stock market trading games or the like, in that it provides a family-type and party game simulating a stock exchange or the like for the enjoyment of children and adult players. The object of the game focuses first in simulating the characteristics of a financial market and second in simulating the functions of a financial market. In short, the game has been provided for fun and entertainment and the features and operations of a financial market have been adapted to the game to be conducted in an entertainment style, rather than adapting the game to simulate the features and operations of a financial market in a realistic style.

The game of this invention provides a simple and functional game board having a plurality of playing spaces, with each of the playing spaces having a different trading symbol printed therein, providing means for the players to conduct simulated trading transactions in a game in which the player, in turn, makes all his/her investments decisions. For example: the selection of a trading symbol to conduct simulated trading transactions is made by the player directly from the game board. The decision of whether to BUY or SELL, is also made by the player using his/her appropriate trading play piece. The player then places his/her trading play piece in the trading symbol's playing space of his/her choice on the game board regardless whether or not the selected trading symbol's playing space is occupied by other/s trading play piece/s.

The game of this invention is characterized by having a designated number of the game trading symbols representing the "Game Average" components in combination with the Game Average indicia displayed in the center area of the game board. The game average components provide an indication of the combined price movement of the investments represented by the trading symbol's game average representative components. A game average record form including play instructions for determining the game average "closing" figure is provided with the game. The game average element provides a significant characteristic and entertainment feature in a family-type and party game simulating a stock exchange or the like.

The designated "News Cards" contain witty messages, fun news, rumors and the like, and include dividend payment notices. In a party game they may include prizes. The designated "Fun-Gram" form provides a blank space therein for the players to print/write their own message to give to another player. The News cards and the Fun-Gram form are used during the news release period or step No. 3 of the game, and are provided to create a business-like atmosphere conducted in a play and entertainment style. The variety of amusing messages and picture indicia printed in the News cards serve as means to help the players use their own imagination in creating their own amusing message to print/-write in the blank space of the Fun-Gram form.

It is an object of this invention to provide a "make believe" stock exchange or the like for players with or without knowledge of the financial world, wherein a player may pretend he/she "buys" and "sells" securities of a large corporation located anywhere in the world, as well as investing in his/her neighborhood store or any other business concern.

It is another object of this invention to provide a simple competitive trading game to be practiced using only one set of instructions for play rather than providing individual instructions for play to the player in each turn.

It is another object of this invention to provide a trading game for the enjoyment of children and for the young in heart.

It is a further object of this invention to provide a trading game and a method of continuing playing.

The game of this invention has been provided to be played "with or without" employing the method of continuing playing.

The game of this invention has been equipped to keep track of the players portfolio holdings by means of the trading play pieces placed on the game board. Each player receives an equal amount of game currency at the start of the game. Simulated BUY and SELL transactions are settled during the game by means of the game currency. The trading play pieces, remaining placed on the board after the 5th session has been completed, are liquidated at game-end by each player, in turn. The player accumulating the most game currency over his/her start up game currency funds wins the game.

Record forms are not required to play a single or double game.

In summary, the trading play pieces and the game currency in combination with the play of the game provide means for determining a player's gain or loss score achieved during the game.

The game of this invention acquired novelty in its own merits and when the game is linked together with the method of continuing playing additional features and characteristics are made possible.

The method of continuing playing has been adapted to function with the game of this invention and provides a plurality of adapted record forms systematically linking together, one by one, the current completed game with the succeeding game to continue playing. The adapted forms contain the game elements indicia related to a player's score to be achieved during the play of a plurality of succeeding games, thereby establishing a "continuous" game contest to be played during an undetermined period of time and which may be played by up to a large group of players and by a varying number of players.

Some of the advantages realized when employing the adapted record forms provided by the method of continuing playing of this invention in conjunction with the game of this invention includes:

Enabling a player to finish his/her participation in the formed continuous game contest independently from each other player, and to score his/her gain or loss achieved during his/her participation in the continuous game contest while the remaining participants continue playing; also, enabling a "new" player to enter and participate in the continuous game contest; and also enabling a player to excuse himself/herself from participating in any of the games forming the continuous game contest and resume playing at a later succeeding game with the same simulated investment portfolio holding number of shares held at the end of his/her last game played.

The object of the game employing the method of continuing playing is to provide a "continuous" game contest whereby the player carries over his/her simulated investment portfolio holdings number of shares the end of a game, to the following succeeding game to continue playing.

Another object of the game employing the method of continuing playing is to provide a "continuous" game contest whereby at the end of the game, the game closes and recesses to re-open and continue in the following succeeding game, and the "closing" prices of the simulated investment, represented by the game trading symbols, are carried over from the completed game and represent the "opening" prices during the first trading session of the succeeding game; and also, the Game Average "closing" figure is similarly carried over to represent the "opening" Game Average of the succeeding game.

Also another object of the game and method of this invention is to provide a game simulating a stock exchange or the like conducted in an entertainment style and which may be played at a "party" by a large group of participants.

Other advantages realized when employing the combination of adapted record forms provided by the method of continuing playing of this invention includes:

Adapted ORDER FORM FIG. 9—Being employed by a player conducting simulated trading transactions, using one order form per trading session, and may be used together with, or may replace the trading play pieces FIG. 3 and/or the game currency FIG. 6D.

Adapted QUOTATION RECORD form FIG.-8—Being used cooperatively by each player, in turn, recording simulated investment prices represented by the game trading symbols using one quotation record form per game, may be employed with, or may replace the informative play pieces FIG. 2.

Adapted GAME SCORE form FIG. 11—Being used by a player, one per game, carrying his/her entire portfolio holdings number of shares at the end of the game over to the succeeding game for continuing playing.

Adapted CUMULATIVE RECORD form FIG. 12—Being used by a player, one form per game, compiling game data comprising and affecting the player's score being achieved during the plurality of succeeding games.

The combination of adapted record forms provided by the method of continuing playing may also replace the use of the game board.

Within the scope of this invention the method of continuing playing may be adapted to function with other existing games.

The foregoing brief description, which contains some of the more significant features and objectives of this invention, will be more clearly understood when taken in conjunction with the accompanying drawings and the following detailed description of this invention. Other features of this invention will become apparent from the examination of the completed application.

BRIEF DESCRIPTION OF THE DRAWINGS

FIG. 2 is a plan view of a sample of informative play pieces, used to post current prices in the playing spaces on the board, with one digital, two digitals or more placed next to each other to form the required number. These informative play pieces are also used to post other game information in the center board spaces.

FIG. 3 is a plan view of a sample of trading play pieces used by each player to indicate a selected investment on the game board.

FIG. 4 illustrates a set of special die being employed during the "Quotation Changes" period. The players may use only one said special die or both.

FIG. 5 is a partial view of FIG. 1 showing trading play pieces FIG. 3 and informative play pieces FIG. 2 added on to illustrate game 2 59 session 1 60 being in progress. The trading play pieces, may also be placed out-side of the letter symbol spaces 73 and said pieces may also be placed, by a player on top of his/her other said pieces occupying the same symbol space. FIG. 5 also shows letter symbols T, X and Y having no play pieces placed there at, indicating the stocks represented by these letter symbols have not been traded. The price for the letter symbols not having been traded, remains at the starting 100 price per share and is not posted in said letter symbols spaces until said symbols are traded. FIG. 5 also shows letter symbols B, C, O and U having informative play pieces there at and no trading play pieces, thereby indicating prior completed closed out transactions in these spaces. The quoted prices apply to both, buy and sell transactions.

FIG. 6 illustrates some news cards facing up, showing samples of the type of messages which may be included in said cards.

FIG. 6B illustrates a stock certificate form sample. OPTIONAL.

FIG. 6C illustrates a Fun-Gram form sample which may be used by a player to send his/her own message to another player during the "News release" period.

FIG. 6D illustrates a sample of game currency.

FIG. 7 illustrates a filled in sample of a work sheet and may be used by a player to keep a record of his/her purchases and sales transactions. OPTIONAL.

FIG. 8B illustrates a portion of a Championship Record sheet.

FIG. 8C illustrates a filled in "Game average" record form.

FIG. 8 illustrates a filled in Quotation record form sample. PROVIDED IN CONJUNCTION WITH THE METHOD OF CONTINUING PLAYING.

FIG. 9 is a plan view of the face side of a filled in sample of an Order form used by a player during the trading session. PROVIDED IN CONJUNCTION

Figure 1:
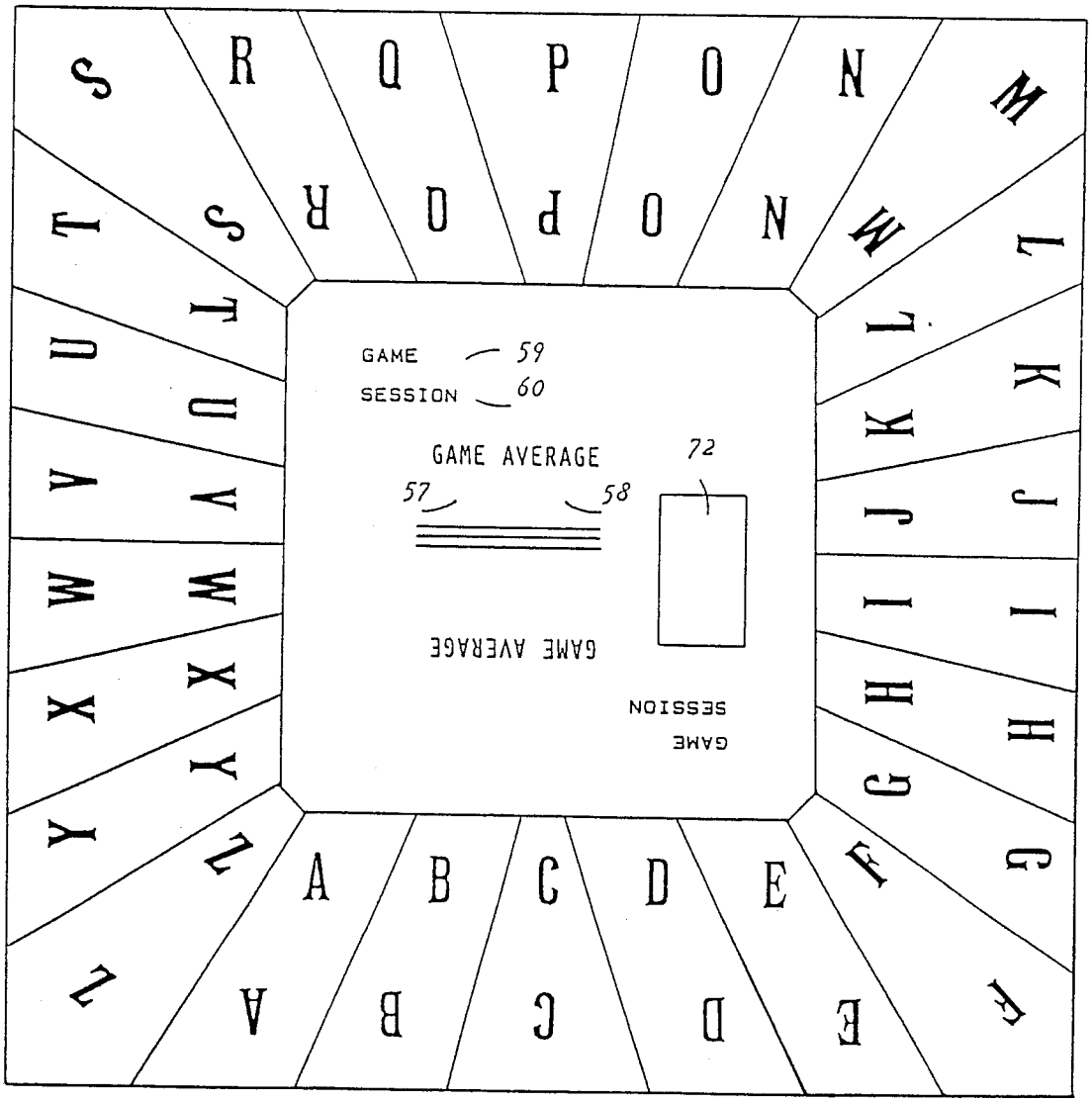
FIG. 1 is a plan view of an exemplary gameboard, with a designated playing surface in accordance with this invention.

WITH THE METHOD OF CONTINUING PLAYING.

FIG. 10 is a plan view of an alternate embodiment of the gameboard positioned up right and which is appropriate for a large group of players participating in the play of the game. Said gameboard may be manufactured to hang on the wall, or it may be provided with a supporting base to rest upright on a flat surface. The trading play pieces and informative play pieces may be adapted to function in accordance with said variation of the game board. SUITABLE FOR A PARTY GAME IN WHICH A LARGE NUMBER OF PLAYERS PARTICIPATE IN THE GAME.

FIG. 10B is another alternative view of the gameboard. The trading of tangible or intangible properties may be conducted by means of the trading symbols displayed on the board, and the center of the board space may display indicia related to the play of the game.

FIG. 11 is a plan view of the face side of a filled in game score record form sample to keep track of a player's portfolio holdings and value. PROVIDED IN CONJUNCTION WITH THE METHOD OF CONTINUING PLAYING.

FIG. 12 is a plan view of the face side of a filled in sample of a comulative record form illustrating a typical accumulation of game data by a player. PROVIDED IN CONJUNCTION WITH THE METHOD OF CONTINUING PLAYING.

EQUIPMENT:

FIG. 1–6, 6C, 6D, 8B and 8C refer to the game.

FIG. 6B and 7 refer to OPTIONAL features of the game.

FIG. 8, 9, 11 and 12 refer to the METHOD OF CONTINUING PLAYING.

FIG. 10 and 10B illustrates an alternate embodiment of the board.

DETAILED DESCRIPTION OF THE PREFERRED EMBODIMENT

THE GAMEBOARD of the preferred embodiment FIG. 1 is of the usual rectangular shape and could be manufactured of cardboard or any other suitable material. The gameboard is characterized by providing trading symbols thereon. A different letter of a complete alphabet, printed in each of the playing spaces bordering a center area, represents the symbols means provided in said playing spaces. The center area of the board shows indicia related to the play of the game. The space 57 and 58 on the gameboard and opposite space thereon have been provided for the "Game Average" indicator, also referred to as the index. Space 72 is provided for the placement of the News cards used during the News Release period. Step No. 3

THE LETTER SYMBOLS provided in said gameboard serve as a "make believe" means wherefrom a player makes his/her selection and may buy or sell securities of a well known Corporation located anywhere in the world, as well as, investing in his/her neighborhood stores or any other business concern selected.

The players favorite Company's shares may be bought and sold during the play of the game. The initial of the Company's first name indicates the game trading symbol under which its stock is traded.

FOR EXAMPLE: General Electron shares may be bought and sold using the letter symbol "G" and also, George's Company shares may be bought and sold using the same letter symbol "G".

Also, the trading symbols provide variation of play, offering the players different approaches to play the game as follows:

FOR EXAMPLE: A plurality of the trading letter symbols on the gameboard FIG. 1 may be designated to represent the game GREEN CHIPS also called "Income Chips" thereby providing the players with another approach to play the game. Instructions for play are set as follows: the players receive a $100 game currency dividend for each 100 shares owned as of the end of the game. Also, these trading letter symbols quotations can not rise or fall over one point during each Quotation Changes period. In order to determine the price changes of the Green Chips letter symbols when rolling the die, the players disregard the value of the numbers on the face up die. Instead, if the result of the rolled die show a PLUS value, the price of the called letter symbol is increased by ONE POINT; and if the die shows a MINUS value, the price is decreased by ONE POINT. If the die show no change the price is left unchanged.

ANOTHER EXAMPLE: Before starting to play the players may determine to play the game in a BULL MARKET MODE or in a BEAR MARKET MODE. The variation in play occurs during the Quotation Changes step in which the players using the game special die disregard the MINUS and PLUS readings and consider only the DIGITAL READING on the face up side of the rolled die in determining the price changes in the game trading symbols. The players do not employ the Green Chips playing style when playing these game variations. The value of all the game trading symbols during the Quotations Changes step are changed following the same rule, as follows:

BULL MARKET MODE. This variation features a BULL market stage wherein investment values are rising. . . and the digital reading on each side of the special game die represents a PLUS VALUE.

BEAR MARKET MODE. This variation features a BEAR market stage wherein investments values are falling. . . and the digital reading on each side of the special game die represents a MINUS VALUE.

The Game Average components, also called to Game Average Index is provided by a designated number of the game trading symbols in the game board and represents a significant characteristics in a family type and party game simulating a Stock Exchange or the like.

THE GAME AVERAGE record form FIG. 8C has been specially designed in conjunction with the designated trading symbols on the gameboard representing the Game Average index in combination with the play of the game, and provides a player with means for determining the "closing" Game Average figure FIG. 5. 57 and 58 For game purposes, the game average is determined as follows: you record the opening prices of each of the game average symbols index 50 at $100 per share. You also record the game average 1000 51 opening figure. At the end of the game, you record the closing price 52 of each of the game average symbols index and the price change 53 of each symbol, which is the difference between the closing and the opening prices. If the total of the plus changes 54 is larger than the total of the minus changes 55 the game average is increased by the difference 56. If the total of the minus changes 55 is larger than the total of the plus changes—the game average is decreased by the difference. The game average figures recorded in this form in the close 57 and change 58 spaces, are also the figures to be posted in the gameboard FIG. 5 Average Indicator 57 and 58 spaces.

THE TRADING PLAY PIECES, FIG. 3 are used during the trading session. The preferred embodiment game is equipped with trading play pieces players and each set contains ten BUY play pieces and ten SELL pieces. The BUY pieces are in one color and the SELL pieces are in another color. Each player's trading play pieces bears a different number to distinguish the trading play pieces of each player from those of each other player.

GAME CURRENCY FIG. 6D. An equal amount, in different denominations, of game currency is provided for each player, and the total player's amount of game currency is doubled to provide for the game funds to be placed in a pot or container to be passed around from one player to another during the trading session. Step No.1.

The trading play pieces sets equipment provided with the game and the game currency bills may be increased to provide equipment to include other players.

THE INFORMATIVE PLAY PIECES, FIG. 2 are used during the Quotation Changes step to post changes of the prices of the stocks represented by the trading symbols on the board. The prices posted apply to both buy and sell transactions and the prices do not change until all the players have completed their trading turn during the same trading session. Each informative play piece bears a digital. The player places one, or more digitals next to each other to form the required number. The informative play pieces are also used to post the Game Average figure 57 nad 58 and the game 59 and session number in progress 60. A container with sections for each of the informative play pieces denominations may be provided with the game. The container also has another section for the UP, DOWN, NO CHANGE and CLOSE Pieces.

The trading play pieces FIG. 3 and the informative play pieces FIG. 2 may be made of a plastic material. The shape of the play pieces may differ from those illustrated.

SPECIAL DIE, FIG. 4, a set of two die specially designed is provided with the game. One die bears the numbers 1, 2 and 3. The other die bears the numbers 3, 4 and 5. The "plain" numbers indicate a plus value and the "encircled" numbers indicate a minus value. The value of the numbers appearing face up on the rolled die are to be combined. For example FIG. 4 shows a face up combination value of plus 2 61.

FOR EXAMPLE:

| | | | |
|---|---|---|---|
| 1 and 3 = | UP 4 | ① and 3 = | UP 2 |
| 1 and 4 = | UP 5 | ① and 4 = | UP 3 |
| 1 and 5 = | UP 6 | ① and 5 = | UP 4 |
| 1 and ③ = | DOWN 2 | ① and ③ = | DOWN 4 |
| 1 and ④ = | DOWN 3 | ① and ④ = | DOWN 5 |
| 1 and ⑤ = | DOWN 4 | ① and ⑤ = | DOWN 6 |
| 2 and 3 = | UP 5 | ② and 3 = | UP 1 |
| 2 and 4 = | UP 6 | ② and 4 = | UP 2 |
| 2 and 5 = | UP 7 | ② and 5 = | UP 3 |
| 2 and ③ = | DOWN 1 | ② and ③ = | DOWN 5 |
| 2 and ④ = | DOWN 2 | ② and ④ = | DOWN 6 |
| 2 and ⑤ = | DOWN 3 | ② and ⑤ = | DOWN 7 |
| 3 and 3 = | UP 6 | ③ and 4 = | UP 1 |
| 3 and 4 = | UP 7 | ③ and 5 = | UP 2 |
| 3 and 5 = | UP 8 | ③ and ③ = | DOWN 6 |
| 3 and ③ = | UNCH. | ③ and ④ = | DOWN 7 |
| 3 and ④ = | DOWN 1 | ③ and ⑤ = | DOWN 8 |

-continued

| | |
|---|---|
| 3 and ⑤ = | DOWN 2 |

The players may pre-determine whether to play the game using either one of the die, or to use both die.

In a variation of the game, an extra player may participate in the play of the game, serving as the "Market Maker" for directing the movement of the prices of the stocks represented by the game trading symbols, thereby replacing the special game die FIG. 4.

The objective of the Market Maker player is to provide another interesting feature to the trading game in accordance with pre-determined instructions for play applicable to the Market Maker marketing approach.

FINANCIAL TRANSACTIONS—Each player settles his/her financial transactions with the player at his/her left side, using his/her allotted game currency FIG. 6D.

THE ACTING BROKER—For game purposes, during the trading session, the player assisting the player at his/her right side is called the Acting Broker.

THE ACTING INVESTOR—Also, for game purposes, during the trading session, the player in his/her turn as he/she buys or sells securities is called the Acting Investor.

TWO WAYS TO PLAY THE GAME. A player places his/her trading play pieces FIG. 3 in any playing space selected by him/her directly from the gameboard FIG. 1. For example:

REGULAR TRADING—a player seeks to buy low and to sell higher at a later time. SHORT TRADING—a player seeks to sell high and to buy lower at a later time.

CLOSED OUT INVESTMENTS—a player's buy and sell trading play pieces placed on the board in the same letter symbol space, cancel each other out and both are removed from the board. For example, When a player purchases a stock, he/she places the "buy" play piece FIG. 3 and pays for the purchase using his/her game currency FIG. 6D. When the player sells the stock he/she places the "sell" play piece FIG. 3 next to his/her buy play piece in the same space, and then receives the proceeds of the sale in game currency FIG. 6D from the "game funds" container. Both buy and sell play pieces thereby cancel each other out and are then removed from the board.

The trading play pieces FIG. 3 remaining placed on the board FIG. 1 at game end are valued as follows: The "buy" trading play pieces as ASSETS and the "sell" play pieces as LIABILITIES. The player, in turn, liquidates his/her entire portfolio holdings using the game "closing" prices posted on the gameboard as shown in FIG. 5. The player receives the proceeds of his/her assets in game currency FIG. 6D. After all the players have liquidated their portfolio holdings and counted their game currency, the player having accumulated the most game currency over his/her start-up funds wins the game. The use of the Work Sheet FIG. 7 is an OPTIONAL feature and not essential in determining a player's score.

NEW CARDS FIG. 6—The cards contain witty messages, fun news and rumors provided for amusement; and include dividend payment notices. The news cards are shuffled and placed face down on the gameboard FIG. 1 72 for the players to draw a card from the top of the cards pile during the news release period.

FUN-GRAM FORMS FIG. 6B—each card provides a blank space thereon for a player to write in his/her own message to another player during the News Release period, also referred to as the Fun-Roundtable. After the drawings of the news cards, one by each player, have been completed, the players may then use the Fun-Gram forms. The players may at the same time also discuss simulated business and entertainment news and views, amusing rumors and the like.

The STOCK CERTIFICATE FIG. 6B is an OPTIONAL feature of the game. When a player places his/her "buy" trading play pieces on the game board, the player pays his/her Acting Broker the current per share price using his/her game currency FIG. 6D. The Acting Broker deposits the game currency received in the game funds container. The stock certificates are kept in the game funds container and the Acting Broker may fill in a stock certificate identifying the investment and number of shares purchased. The stock certificate is kept by the player until he/she sells this investment and returns the stock certificate to his/her Acting Broker. Stock Certificates printed in a different color paper may identify short sales.

STARTING THE GAME

The preferred embodiment is equipped for 2 to 4 players. The players may elect to play a single or double game.

Each player is given by the game organizer $100,000 in game currency denominations as follows: 6 of each 500, 5,000 and 10,000 bills and 7 of 1,000. Also 10 buy trading play pieces and 10 sell trading play pieces. For a double game the players receive 2 additional 50,000 bills. As the players complete some of their trading transactions during the game, the trading play pieces may be used again. The remaining game currency is placed in a container which may be provided with the game. Also, a standard die cup may be provided with the specially designed set of two die. The news cards, including the dividend notice cards are shuffled and placed face down at the center board space 72. The Fun-Gram forms are kept apart for a player using same during the News release period. The informative play pieces are kept in a sectional container making them readily available to be used during the Quotation Changes step. The gameboard FIG. 1 may be placed at the center of a table.

The players determine who is to start the game and then, continue to play in that order during each step of the game. The others follow in order to that player's left. The game does not offer any advantage to the player taking his/her turn first over the player taking his/her turn last. The current price of the stocks traded under any of the trading symbols on the gameboard does not change until all the players have taken their trading turns during the same trading session.

One set of instructions for play, contained in a booklet, is to be followed by all the players alike during every step of the game.

STEP NO. 1—TRADING SESSION

For example, instructions for play may have been provided for as follows:

The starting price for the stocks represented by the 26 letter symbols on the gameboard is $100 per share.

A player, in turn, executes his/her trading transactions by means of his/her "buy" or "sell" trading play piece FIG. 3.

Each trading play piece has a quantity value of 100 shares. Each player shall use no more than two trading play pieces per turn, and may use his/her two trading play pieces in one transaction or may elect to make two different transactions. A player may only by and sell shares in quantities of 100 or 200 per turn.

A player, in turn, may complete and close out any or all his/her trading transactions during the game, however he/she can not increase his/her trading allowance. The value of his/her trading play pieces remaining placed on the board at game-end is included in his/her score.

At the end of the 5th session, or 10th session in a double game, each player, in turn, liquidates his/her entire portfolio holdings, if any, using the "closing" prices of the last session played.

When a player places his/her "buy" play piece on the board, he/she pays the current price to his/her Acting Broker, who shall deposit the game currency bills in the "game funds" container.

As a player's places his/her "sell" play pieces, he/she shall be paid the current price with "game fund" bills by his/her Acting Broker.

FOR EXAMPLE: The current price for the stocks represented by the letter symbol "K" is $110. If a player "buys" 100 shares of K-Market Shops, he/she places one buy play piece in the letter symbol "K" space, and pay $11,000 in game currency to the Acting Broker.

ANOTHER EXAMPLE: a player, in turn, has chosen to buy 100 shares of General Electron. Another player, in his/her turn, want to BUY or SELL 100 shares of Georges Company. In both transactions, the Companies first name initial is "G" and would be traded under the same letter symbol "G" at the current market prices.

After all the players have taken their trading turns, the game proceeds with the Quotation Changes step.

STEP NO. 2—QUOTATION CHANGES

The roll of the dice determines the price movement of the stocks represented by the letter symbols on the gameboard under which the stocks are traded.

Playing in the same order as in Step No. 1, each player calls out, one per turn, in alphabetical order, only the "traded" letter symbols on the gameboard. After a player calls a "traded" symbol, he/she rolls the two die once and then posts the resulting price in the letter symbol space accordingly, using the informative play pieces FIG. 2.

FOR EXAMPLE: Beginning with the letter symbol "A", if it was traded, a player, in turn, may call out the name of his/her favorite Company whose initial of the first name is "A", or the player may simply call out the letter "A". Then, the player rolls the two die once, and posts the resulting price in the letter symbol "A" space accordingly. Said resulting price is obtained as follows: the letter symbol "A" shows a current market price of $112 posted in the letter symbol "A" space.

FOR EXAMPLE: the rolled dice show a face up combined value of "PLUS 2" FIG. 4 61. Then, using the informative play pieces FIG. 2 the player changes the $112 price to the resulting price of $114. If the value of the rolled die shows NO CHANGE, the price remains the same.

Instructions for play may also include how to play the game with variations within the scope of the invention.

The players may elect to call, roll the dice for, and change the price of any "non-traded" stock letter symbol during each Quotation Changes period.

STEP NO. 3—NEWS RELEASE PERIOD

All players, in turn, draw a card from the top of the fun news cards pile placed on the gameboard FIG. 1 72. If the card contains a fun message, the players return the card by placing it face down at the bottom of the pile. If the card contains a dividend or game currency message, the players keep the card till the end of the game for inclusion of its value in their score.

The players, in any order, may use the Fun-Gram forms to write in their own entertaining message to send to each other. When a player receives a Fun-Gram message he/she should read it to the other players.

During the News release period, also referred to as the Fun-Roundtable, the players may orally exchange witty and amusing news, rumors or the like merely for laughs.

The variety of the entertaining messages in the game "News cards" are also intended to serve as a means to help a player to use his/her imagination in creating his/her own amusing message in a fun atmosphere.

After Step No. 3 has been completed, the game moves on to the next trading session or step No. 1 of the game.

END OF THE GAME

The game ends after all the steps of session 5 in a single game, or session 10 in a double game, have been completed by all the players. The prices resulting from the last Quotation Changes period are the "closing" prices for the game.

The value of the player's trading play pieces remaining placed on the board are included in their score.

THE PLAYERS TAKE TURNS IN LIQUIDATING THEIR PORTFOLIO.

The "buy" trading play pieces are valued as ASSETS.

The "sell" trading play pieces as LIABILITIES.

A player receives the "closing" price for each of his/her "buy" trading play pieces remaining placed on the board. A player pays the "closing" price for each of his/her "sell" trading play pieces remaining placed on the board. A player also collects the monetary fun value of any News cards held by him/her at the end of the game.

EACH PLAYER IS ASSISTED BY HIS/HER ACTING BROKER.

Each player then counts his/her game currency, and the player having achieved the largest gain wins the game.

FOR EXAMPLE

A player may finish his/her game with the following score:

| | |
|---|---|
| Game currency on hand - after buying & selling during the game | $62,000 |
| Plus his/her "buy" play pieces assets remaining on the board | 60,000 |
| Plus dividends received from news cards at game-end | 500 |
| TOTAL | $122,500 |
| Less his/her "sell" play pieces liabilities placed on the board | 11,000 |
| Player's game currency held at game-end | $111,500 |

-continued

| | |
|---|---|
| Less player's game currency start-up funds | 100,000 |
| PLAYER'S GAIN OR SCORE | $ 11,500 |

THE USE OF THE "WORK SHEET" FIG. 7 IS OPTIONAL

It is provided to help a player plan his/her moves and to improve his/her skill.

QUANTITY numbers are recorded in 100 UNITS.

BUY quantity numbers are recorded in PLAIN numbers.

SELL quantity numbers are recorded in ENCIRCLED numbers.

PRICES are recorded on a PER SHARE basis.

FIG. 7 illustrates a player's filled in "Work Sheet" sample form as follows:

A player bought during session 1 column 62 100 shares trading under letter symbol "A" for $100 per share, and also bought 100 shares traded under letter symbol "N" at $100 per share. Session 2 column 63 shows said player bought 200 shares under the letter symbol "S" at $105 per share. Session 3 64 shows that said player bought 100 shares traded under letter symbol "F" for $110 per share and also shows said player sold "short" 100 shares traded under letter symbol "K" for $120 per share. Session 4 column 65 shows said player bought 200 shares traded under letter symbol "G" for $105 per share. Session 5 column 66 shows said player sold 100 shares traded under letter symbol "G" for $110 each share, and also sold 100 shares traded under letter symbol "N" for $110 each share.As the prices during the game and the new prices are posted on the gameboard, the player using the "Work Sheet" keeps track of the prices paid/received for his/her investments. If you are playing a double game you use one form for each game.

The foregoing disclosed game of this invention may also be equipped to be played by a group of players.

FOR EXAMPLE: Equipment for a "party" game includes one set of trading play pieces FIG. 3 for each player; equal amount of game currency FIG. 6D in different denominations for each player and a sufficient amount of the game currency bills for the game funds container and an adequate supply of news cards FIG. 6, which may include party give away prizes. A Market Maker player may replace the use of the special die FIG. 4 for directing the price changes of the trading symbols FIG. 5 during the Quotation Changes period. The Market Maker player may use the Fun-Gram forms to provide clues, market trends and other useful hints to the players during the game for them to figure out the Market Maker's pricing strategy. The Market Maker posts the new prices in each of the trading symbol spaces as shown in FIG. 5 using the informative play pieces FIG. 2. The gameboard FIG. 1 is placed at the center of a large table. The player, in turn, places his/her trading play piece FIG. 3 in any trading symbol space or outside the board pointing to the selected trading symbol space FIG. 5 73. The players may play a single or double game.

From the foregoing disclosure, it is apparent that the game of this invention provides a competitive and entertaining game for players with or without any knowledge of the world of finance, and that the multiple objectives of this game invention have been fully accomplished. It is to be understood that variations and changes may be made in the preferred embodiment of this invention to provide other type of games, without departing from the scope of this invention.

METHOD OF CONTINUING PLAYING

Hereafter, as a matter of clarification and where distinction is required, the game of this invention is referred to as the "5 sessions game" and when linked together with the method of continuing playing it is referred to as the "continuous game".

When employing the method of continuing playing the "5 sessions game" is played as previously disclosed in the foregoing specifications, systematically employing the combination of adapted record forms.

The method of continuing playing provides a "continuous game" contest formed by a plurality of succeeding "5 sessions games" to be played over an undetermined period of time and by a varying group of players. The "continuous game" closes at the end of every "5 sessions game" and re-opens in the following game for continuing playing with each of the contest elements having the same standing as held at the end of the previous 5 sessions game.

FOR EXAMPLE: trading symbols on the gameboard FIG. 1 "closing" quotations at game-end are carried over from one game to the next. Game Average closing figure 57 is also similarly carried over; and the player starts the next game with the same portfolio holdings number of shares held at the end of the previous completed game.

The Quotation Record form FIG. 8; Order form FIG. 9; Game Score form FIG. 11 and Cumulative Record form FIG. 12 are provided in combination with one another making possible the accomplishment of the steps comprising this invention method of continuing playing.

Informative play pieces FIG. 2 may be used in conjunction with the Quotation Record form FIG. 8.

Trading play pieces FIG. 3 are replaced by the Order form FIG. 9. 4 Game currency bills FIG. 6D are replaced by the combined forms FIG. 9, 11 and 12.

Before starting to play a new game, the gameboard FIG. 1 is prepared to display in each one of the trading letter symbols spaces the previous "5 sessions game" closing prices, shown in said previous Quotation Record form FIG. 8 column 89, and which now represent the starting prices for continuing playing. Also, said column 89 prices are carried over to the next game Quotation Record form, Session 1 column 84 for continuing playing.

A player participating in the "continuous game" is provided with five order forms FIG. 9, one for each session of the game; one Game Score form FIG. 11 and one Comulative Record form FIG. 12 per game.

A player's filled in samples FIG. 11 and FIG. 12 show said player's portfolio value and "paper" score to date.

An ACTUAL SCORE is achieved only after a player has converted his/her entire portfolio holdings into game currency, within the rules, regardless of the position taken by the other participants in the contest.

The player with the highest actual score is the "Champion" until another player finishes his/her participation in the game with a higher actual score. Each player liquidating his/her entire portfolio with a profit wins the game. An actual score is final and not cumulative in future "continuous game". A player can better his/her previous score as a new player.

GAME ABSENCES—The method of continuing playing of this invention makes provision for a player to absent himself/herself from some of the 5 sessions games comprising a continuous game, and for the player's entire portfolio number of shares to be carried over from the last game played to the present game for continuing playing.

NEW PLAYERS—The method of continuing playing also makes possible that new players may enter the game and play in a 5 sessions game comprising a continuous game contest in progress.

GAME NUMERICAL ORDER—The 5 sessions game is numbered consecutively as played, and when a player enters the continuous game at a later date, he/she records the number of the game 91 in progress, date 92, and his/her name 93 in said player's game record forms. Each Acting Investor's record forms FIG. 9, 11 and 12 are O.K'd and initialed by each player's Acting Broker. A player's Acting Broker during one game is not necessarily his/her Acting Broker in the next game. A player's acting broker is the player sitting at his/her left side. When a large group of players are participating in the game and comprise more than one group, the players determine the consecutive order of play for each group. This order is maintained thru out the game.

COMMISSION—A player using an order form in the continuous game, pays $10 for each transaction shown therein. FIG. 9 83.

STEP NO. 1—TRADING SESSION

FOR EXAMPLE: Rules for play applicable to the continuous game may be indicated as follows:

A player may buy and/or sell up to 100 shares per trading session. A player may conductg a single 100 shares transaction or may divide the trading allowance into 2 or more transactions in any multiple of 10 shares.

A player executes his/her trading transactions by filling in the trading data in the "order form" FIG. 9. The quantities of the trading transactions are recorded by filling in the total number of shares, and prices are recorded on a per share basis.

FOR EXAMPLE: filled in order form sample FIG. 9 shows a player prepared a form during one trading session showing a purchase of 50 shares 75 of stock traded under letter symbol "G" for $95 per share 76; said player also bought 10 shares 75 traded under letter symbol "K" for $105 per share 76; said player also sold 20 shares 78 traded under letter symbol "C" for $110 per share 79; and also sold 20 shares 78 traded under letter symbol "S" for $120 per share 79. Said player's order form shows in the purchases column 77 the amounts of $4750 and $1050 totaling $5800 81; and sales column 80 showing the amounts $2200 and $2400 totaling $4600 82. COMMISSION 83 at a rate of $10 per transaction shows a total of $40 in this order form.

STEP NO. 2—QUOTATION CHANGES

The players in turn participate in the Quotation Changes step, as outlined in the foregoing detailed description of the preferred 5 sessions game embodiment of this invention.

IN ADDITION, One Quotation Record form FIG. 8 per game is used and filled in by each player, in turn, during the Quotation Changes step. The prices resulting from the present quotation changes period are recorded in the next trading session column. The prices established during the 5th Quotation Changes period are the "closing" prices for the game played. These prices are later transferred to the next quotation record form and are the opening prices to be used in Session 1 84 of the following game.

FOR EXAMPLE: Filled in sample of the Quotation Record form FIG. 8 shows a $100 start-up, buy or sell price for the stocks traded during session 1 84 under any of the game trading letter symbols; columns 85, 86, 87 and 88 show the changes in the prices for all of the traded letter symbols resulting from the roll of the die during each Quotation Changes period; close column 89 shows the "closing" prices for the game played. An empty space in a trading symbol's line shows that said trading symbol had not been called out. Three dots in a trading symbol's line space columns 89 and 90 indicate that said trading symbol had not been traded and the starting price remains unchanged; trading letter symbols "C", "H", "L" and "Y" lines show no early trading and that later in the game these letter symbols were called, the die rolled and the price changes recorded. The difference in the price between the first column 84 and the "close" column 89 quotations of each of the stock letter symbols, is the price change 90 for each letter symbol of the game.

STEP NO. 3NEWS RELEASE PERIOD

The players, in turn, participate in the news release period as outlined in the foregoing detailed description of the preferred embodiment of the game of this invention.

GAME SCORE FORM—FIG. 11

Each player uses one Game Score form for each 5 sessions game.

FOR EXAMPLE: Filled in sample FIG. 11 shows a player completed his/her form as follows:

"Quantities carried over" column 95 down the line shows said player's entire portfolio holdings at the end of the previous game. Said player's "owned" shares recorded in plain numbers and said player's shares "sold short" recorded in encircled numbers.

"Trading Session" columns show said player recorded, in the corresponding stock symbol line and session number columns, his/her current game trading data as shown in his/her 5 current order forms, using quantity data only. BUY data recorded in PLAIN numbers and SELL data recorded in ENCIRCLED numbers. Column 96 shows said player during session 1 bought 50 shares traded under letter symbol "E" and 50 shares traded under letter symbol "K"; during session 2 97 said player bought 10 shares traded under letter symbol "B" and 90 shares under letter symbol "S"; said player, during session 3 98 sold 10 shares under letter symbol "B", also, sold 50 shares traded under letter symbol "G", and sold 20 shares traded under letter symbol "I", and also bought 20 shares traded under letter symbol "S"; during session 4 98 said player sold "short" 10 shares of stock traded under letter symbol "N", bought 50 shares to replace some stock previously sold "short" under letter symbol "P" and bought 40 shares under letter symbol "U", during session 5 100 said player bought 50 shares traded under letter symbol "I" and sold 50 shares under letter symbol "S".

Said sample "Game Score" form also shows that said player up-dated his/her portfolio holdings using the "close" Qty column 101 as follows: letter symbol "B" line 109 recorded data as follows: no shares carried over from previous game, 10 shares bought during session 2 and 10 shares sold during session 3 leaving a total of "0" in the "close" Qty. column; letter symbol "E" line 110 shows 60 owned shares carried over and 50 shares bought totaling 110 shares in the "close" Qty. column; letter symbol "G" line shows 50 owned shares carried over column 95 and 50 shares sold during session 3 leaving no balance; letter symbol "I" line 112 shows 20 owned shares carried over, 20 shares sold during session 3 and 50 shares bought during session 5 leaving a total of 50 owned shares in the "close" Qty. column 101; down the line said player's portfolio holdings had been up-dated to show said player's entire portfolio holdings in the "close" Qty. column 101 to be carried over to the following game score form FIG. 11 to be recorded in the Quantities carried over column 95 for continuing playing.

"Close" price column 102, shows the closing prices at the end of said game for the stocks represented by the letter symbols related to said player's up-dated portfolio column 101. Said closing prices are recorded in said game "Quotation Record" form FIG. 8 column 103 shows said player's portfolio number of shares owned multiplied by the "closing " price and valued at $12,650; $6,500; $16,500; $12,000; $3,600 and $2,000 resulting in a total 105 of $53,250. Short sales column 104 shows recorded values of $2,100: $6,000 and $1,150 totaling $9,250 in 106.

CUMULATIVE RECORD—FIG. 12

This form serves as a current status of a player's paper score updated thru the last game played.

In this form, the player records the latest game results, accumulates the figures and carries them over from game to game.

Each player uses one Cumulative Record form for each 5 sessions game.

FOR EXAMPLE: filled in sample FIG. 12 shows a player completed his/her form as follows:

LINE 1 TO LINE 5 show purchases and sales amounts from said player's 5 trading ORDER FORMS FIG. 9, filled in during the 5 sessions of this game.

LINE 6 shows said player's total purchases for this game.

LINE 7 shows said player's total sales for this game.

LINES 8, 11, 14 and 17 show carried over amounts for each of these items from said player's previous game CUMULATIVE RECORD form FIG. 12, lines 10, 13, 16 and 19 respectively.

LINE 9 shows said player totaled the commissions in his/her 5 trading Order forms FIG. 9, for this game and recorded the total thereon. LINE 12 shows said player's total purchases from line 6.

LINE 15 shows said player's total sales from line 7.

LINE 18 shows any income credit that said player received from "news cards" and "green chips" dividends during the game.

LINES 10, 13, 16 and 19 show said player added on the "carried over" and "this game" recorded amounts for each one of these items and recorded each total on the "cumulative" lines therein. These recorded cumulative amounts are later carried over to said player's next game Cumulative Record form FIG. 12, on lines 8, 11, 14 and 17 for continuing playing.

LINE 20 shows cumulative purchases from line 13.

LINE 21 shows cumulative sales from line 16.

LINE 22 cumulative commissions from line 10.

LINE 23 shows cumulative credits from line 19.

LINE 24 shows said player's portfolio assets value from said player's Game Score form FIG. 11, Regular trading line 105. (Said player's Game Score form not illustrated herein).

LINE 25 shows said player's portfolio liabilities value from said player's Game Score form FIG. 11, Short trading line 106.

LINE 26 shows amounts from line 20, 22 and 25 added and the total recorded thereon.

LINE 27 shows lines 21, 23 and 24 added and the total recorded thereon.

LINE 28 shows said player's up-dated credit amount from line 27.

LINE 29 shows said player's up-dated charge amount from line 26.

LINE 30 shows said player deducted line 29 from line 28 to arrive at said player's gain score up-dated thru this game. If line 29 amount IS LARGER than line 28 amount, the the credits amount is deducted from the charges amount and the difference is recorded and BRACKETED thereon to show a LOSS score.

ACTUAL SCORE—An Actual Score is achieved only after a player has liquidated his/her entire portfolio holdings in accordance with the instructions for play.

CLOSING OF THE 5 ≠SESSIONS GAME

Each player at the end of the 5 sessions game completes his/her Game Score form FIG. 11 and his/her Cumulative Record form FIG. 12. Said forms are O.K'd and initialled by each player's Acting Broker.

ANOTHER 5 SESSIONS GAME

The game re-opens with the same quotations and Game Average figure as it had previously closed at. Each player transfers his/her entire portfolio holdings number of shares from his/her Game Score FIG. 11 column 101 to the new Game Score form column 95 to be used during the current game. Each player also transfers his/her cumulative records from his/her Cumulative Record form FIG. 12 lines 10, 13, 16 and 19 to the new Cumulative Record form to be used during the current game lines 8, 11, 14 and 17 respectively.

A PLAYER FINISHES HIS/HER OWN GAME

Each player participating in the "continuous game" decides how many 5 sessions games to play. Each player plans his/her moves which offer the best means of winning the game independently from the other players. Each player liquidating his/her entire portfolio holdings with a profit wins the game. The player with the highest Actual Score on Record is the Champion until another player finishes his/her own game with a higher score.

A separate Championship Record form FIG. 8B is maintained for players participating in the 5 sessions game and for players participating in the continuous game of this invention.

TRADING ALLOWANCE EXCEPTION APPLICABLE TO THE CONTINUOUS GAME.

When a player's portfolio holdings number of shares at the beginning of the 5 sessions game is under 1000 shares, and the player wishes to LIQUIDATE his/her entire portfolio in order to achieve an ACTUAL SCORE, he/she may, during one session or over a period of 5 sessions of the game, LIQUIDATE his/her entire portofolio. Mixed transactions of BUY and SELL orders are permitted.

The outlined detailed description of the 5 sessions game preferred embodiment of this invention and the continuous game version may be practiced together during the course of the same game.

FOR EXAMPLE: A player may use the trading play pieces FIG. 3 and the game currency FIG. 6D during the play of the continuous game, said player terminates his/her participation in the game, as outlined in the preferred embodiment of this invention.

It is to be understood that multiple variations of the features of the trading game of this invention and method of continuing playing have "become" apparent in the light of the foregoing disclosure. Any variations described within the foregoing specifications have been introduced as examples and are not to be considered limiting in any way.

Accordingly, it is understood that the game of this invention may be practiced and the method of continuing playing of this invention, may be employed with changes and modifications from those that have been specifically disclosed herein; and that each specific term herein includes all technical equivalents which operate in a similar manner to accomplish a similar purpose, including the various features of novelty herein set forth, taken either singly or in "combination" and which have been introduced by means of illustrations and are not intended to be limiting in any way.

What is claimed is:

1. In a trading game a method for continuing playing comprising the steps of:

recording of game data;

up-dating said game data according to successively related play of the game arriving at a game-end data result;

compiling said game-end data result with the following game related data result arriving at the cumulative game record data result;

continuing said recording, up-dating and compiling of game data comprising each of the elements of a player's score;

providing an "order form" having pertinent columnar headings; said form having trading symbols indicia occupying the first column, with each said trading symbol occupying a different line in said first column; said form providing means for recording and totaling simulated trading transactions and total commission fees for said simulated trading transactions conducted by means of said order form; said form being used by a player one said form per trading session in accordance with predetermined instructions for play;

providing a "quotation record" form having pertinent columnar headings and trading symbols indicia occupying the first column, with said trading symbols each occupying a different line thereon; said form providing means for recording a starting price for each trading symbol; changes in said price during the play of the game including a "closing" price and the total change in said starting price for the game played; said form being used during the play of the game;

providing a "game score" form having pertinent columnar headings and trading symbols indicia occupying the first column, with each said trading symbol occupying a different line thereon; said form providing means for a player carrying over his/her entire portfolio holdings record from his/her previous game said form; and also providing means for said player recording current game data required for having said player's outstanding portfolio holdings record up-dated to the current game-end; said game score form includes means for said player evaluating said up-dated outstanding portfolio; said form being used one per game in conjunction with said order form and said quotation record form;

providing a "cumulative game record" form having carried over indicia and means of recording the previous game cumulative record result; said form providing current game indicia and means for recording the current game related data; said form also having cumulative indicia and means for arriving at the current game cumulative record result for each item therein; said form further providing means for arriving at said player's up-dated game equity and score; said form used by a player, one said form per game in conjunction with said order form and said game score form.

2. In a trading game a method of continuing playing comprising:

recording a player's playing activity and related game data during the play of a game using an adapted conveying instrument systematically carrying the recorded data results over to the succeeding said game; said recording of data includes each one of the elements affecting a player's score being achieved during the play of a plurality of succeeding said game;

updating the recorded data results being carried over and combined with similar data being recorded during the succeeding said game using said adapted conveying instrument;

compiling the updated recorded data results being carried over to the succeeding said game systematically using said adapted conveying instrument linking together the completed game with the succeeding said game; said adapted conveying instrument having provisions for systematically recording, updating and compiling pertinent data comprising and affecting a player's score;

thereafter systematically repeating said recording, said updating and said compiling steps establishing a continuous game contest being played over an undetermined period of time by a varying number of players participating in the continuous game contest being established by the plurality of succeeding said game wherein during any of the succeeding games a player, independently from each other player, may score his/her gain or loss achieved during his/her participation in said continuous game contest;

adapting a combination of record forms to function with the game of this invention having means representing each one of the game elements affecting a player's score and means for recording, updating and compiling required data thereon; said combination of adapted record forms enabling a player carrying over his/her outstanding portfolio number of shares from a completed game to the succeeding said game, and enabling the player to finish his/her game participation while the remaining players continue playing; and also, enabling a "new" player to enter and participate in any of the succeeding said game; and also enabling any of the players to excuse himself/herself temporarily from participating in one or more of the succeeding said game and to resume playing at a later succeeding said game having the same portfolio holdings number of shares as of his/her last said game played;

providing an adapted order form for a player systematically recording simulated trading transactions using one said order form per trading session;

providing an adapted order form for the players cooperatively using one said quotation record form per game for systematically recording a starting price, changes in said price and a closing price being carried over to the succeeding said game;

providing an adapted game score form for a player using one said form per game systematically maintaining an updated portfolio holdings number of shares carried over to the succeeding said game;

providing an adapted cumulative record form for a player using one said form per game systematically maintaining a continuous accumulation and compilation of the recorded data for each item therein; said cumulative record form enabling a player determining his/her game paper score updated to the last game played and recorded thereon.

3. In a trading game a method of continuing playing as set forth in claim 2 in which said conveying instrument may be adapted to systematically function with another designated existing game in accordance with the provided method of continuing playing of this invention.

4. A trading game for playing a plurality of game variations simulating the buying and selling of at least one of a plurality of tangible and intangible properties, said trading game comprising: a gameboard having a primary area segmented into a predetermined number of playing spaces providing accommodation for defining a plurality of playing activities conducted by players during a game, with each player participating in at least one of said plurality of playing activities per turn in accordance with predetermined instructions for play; each of said playing spaces in said primary area being distinguished from one another by one of a plurality of unique trading symbols printed thereon, each of said trading symbols representing at least one another by one of a plurality of properties;

means for setting value and repeatedly determining a current value related to said trading symbols on each game board;

a plurality of trading play pieces, each adapted to be selectively placed on any of of said playing spaces; said trading play pieces include "buy" trading play pieces and "sell" trading play pieces; means distinguishing said "buy" trading play pieces from said "sell" trading play pieces; said plurality of playing activities include the buying of properties by selectively placing a "buy" trading play piece on the playing space representing the selected property and the selling of properties by selectively placing a "sell" trading play piece on the playing space representing the selected property;

trading exchange means cooperating with said gameboard, said setting value means and said trading play pieces providing in combination scoring means for playing said game.

5. The trading game of claim 4 in which said setting value means includes a plurality of informative play pieces with some of the pieces bearing a digital and other pieces bearing informative indicia; said informative play pieces used to post current prices at the trading symbols' playing spaces on the gameboard, using one digital, or more placed next to each other to form the required number, and also said informative play pieces may be used to post current information related to the play of the game.

6. The trading game of claim 5 wherein the gameboard provides means for a plurality of informative play pieces and a plurality of trading play pieces occupying any of the playing spaces of said gameboard at the same time.

7. The trading game of claim 4 wherein said gameboard having each playing space being designated as a "starting space" for a player to place a play piece therein.

8. The trading game of claim 4 wherein said gameboard provides means for a plurality of trading play pieces, including "buy" and "sell" pieces to occupy any of the playing spaces of said gameboard at the same time.

9. The trading game of claim 8 wherein said gameboard provides means for a player to place his/her trading play piece in any of the playing spaces of said gameboard.

10. The trading game of claim 9 wherein said gameboard provides means for a player's trading play piece occupying any of the playing spaces of said gameboard until removed by the player having placed said trading play piece.

11. The trading game of claim 4 in which said setting value means includes a chance means of at least one die having six sides; three sides of said die, each side bearing a different digital, and each of their opposite counterpart sides bearing a digital identical to each digital of the said opposite side of said die; a minus reading is provided by marking each one side of said three sides bearing a different digital and leaving the three opposite counterpart sides unmarked; said minus reading is indicated by the digital appearing in each of the three marked sides of said die.

12. The trading game of claim 4 wherein said gameboard having each playing space being occupied by a unique trading symbol for the players selecting, indicating and conducting simulated trading 13. The trading game of claim 4 wherein further comprising a plurality of designated news cards containing fun news, brief amusing messages, rumors and the like, game currency dividend payment notices and may include picture indicia; said news cards being placed in a pile face down to be drawn in succession from the top by a player in turn during the play of the game; said news cards providing a fun atmosphere in a family type and party game.

14. The trading game of claim 13 wherein further comprising a plurality of a designated fun-gram form providing a blank space for a player electing to use said form, in any order after the drawing of the news cards have been completed, to write/print own play message in the provided space and to give same to any other player; said fun-gram provided in combination with said news cards and the play of the game.

15. The trading game of claim 4 in which further comprising:

plurality of designated championship record sheets for maintaining a record of the highest score achieved by a player during a game, and the player remaining champion until a higher score is achieved by any player during the play of any future game;

plurality of work sheet forms which may be used by a player as means for planning and improving his/her score; said work sheet form is an optional feature of the game;

plurality of stock certificate forms which may be used by a player during the trading session; said stock certificate form is an optional feature of the game;

a pair of the game special die;

plurality of container means;

instructions for play booklet.

16. The trading of claim 4 in which said gameboard providing means for simulating a game average indicator by making available a predetermined number of the trading symbols on said gameboard to represent the game average indicator in combination with said setting value means and the play of the game; said game average indicator having a starting valuation figure; means for arriving at a closing figure related to said game average indicator and a total valuation change in the starting valuation figure during the play of the game.

17. A trading game for playing a plurality of game variations simulating the buying and selling of at least one of a plurality of tangible and intangible properties, said trading game comprising: a gameboard having a primary area segmented into a predetermined number of playing spaces providing accommodation for defining a plurality of playing activities conducted by players during a game, with each player participating in at least one of said plurality of playing activities per turn in accordance with predetermined instructions for play; said gameboard also having a secondary area providing a minority of spaces which may display indicia therein related to the play of the game and also having at least one space reserved for the placement of playing cards to be drawn by players during the play of the game; each of said playing spaces in said primary area being distinguished from one another by one of a plurality of unique trading symbols printed thereon, each of said trading symbols representing at least one of a plurality of properties;

a chance means of at least one die having six sides; three sides of said die, each side bearing a different digital, and each of their opposite counterpart sides bearing a digital identical to each digital on said opposite side of said die; a minus reading is provided by marking each one side of said three sides bearing a different digital and leaving the three opposite counterpart sides unmarked; the minus reading is indicated by the digital appearing in each of the three marked sides of said die;

means for simulating a game average indicator having a starting valuation figure and being represented by a predetermined number of said trading symbols on said gameboard; means for determining a valuation change in each of the trading symbols representing the game average indicator in cooperation with said change means and the play of the game; and means for arriving at a closing figure related to said game average indicator and a total valuation change in the starting valuation figure during the play of the game, including a supply of a game average form and instructions for using same; a plurality of trading play pieces for each player; said trading play pieces having distinctive numerical indicia to distinguish said trading play pieces of each player from those of each other player; said trading play pieces each representing a predetermined quantity amount; said trading play pieces each adapted to be selectively placed on any one of said playing spaces; said trading play pieces include buy trading play pieces and sell trading play pieces; color coding means distinguishing said buy trading play pieces from said sell trading play pieces; said plurality of playing activities include the buying of properties by selectively placing a buy trading play piece on the playing space representing the selected property and the selling of properties by selectively placing a sell trading play piece on the playing space representing the selected property; a plurality of informative play pieces provided in combination with said plurality of unique trading symbols; said informative play pieces having a plurality of the pieces bearing a digital and the other pieces bearing informative indicia; said informative play pieces each adapted to post current prices at the trading symbols' playing spaces in the gameboard, with one digital, two or more placed next to each other to form the required number, and also to post current information related to the game in cooperation with the secondary are of said gameboard;

a plurality of news cards containing brief amusing messages, fun news, rumors and the like, dividend payment notices and may contain picture indicia; said news cards being placed in a pile face down on said gameboard space provided to be drawn in succession from the top by a player in turn during the play of the game;

a plurality of a designated fun-gram form providing a blank space for a player electing to use said form, in any order, to write/print own play message in the provided space and to give same to any other player; said fun-gram form provided in cooperation with said news cards and the play of the game;

a plurality of championship record sheets for maintaining a record of the highest score achieved by a player to date and the player remaining champion until a higher score is achieved by any player during the play of any future game;

a plurality of game currency means provided in conjunction with said trading play pieces being capable of determining each player's gain or loss achieved during the game;

a plurality of container means;

instructions for play booklet.

18. The trading game of claim 17 in which including a plurality of adapted record forms in combination with one another and having pertinent indicia comprising and affecting a player's score and means for systematically recording, updating and compiling pertinent data being carried over to the succeeding game establishing a continuous game contest being maintained by the plurality of said succeeding game.

19. The trading game of claim 18 wherein said plurality of adapted record forms in combination further providing means for the players participating in the continuous game contest playing independently from one another and enabling a player finishing his/her participation and scoring his/her gain or loss achieved during his/her participation in the continuous game contest; said plurality of adapted record forms also enabling a "new" player entering and participating in the continuous game contest during the play of any of the succeeding games comprising said continuous game contest.

20. A trading game for playing a plurality of game variations simulating the buying and selling of at least one of a plurality of tangible and intangible properties, said trading game comprising:

a gameboard having a primary area segmented into a predetermined number of playing spaces providing accommodation for defining a plurality of playing activities conducted by players during a game, with each player participating in at least one of said plurality of playing activities per turn in accordance with predetermined instructions for play; said gameboard also having a secondary area providing a minority of spaces which may display indicia thereon related to the play of the game including a game average indicia; each of said playing spaces in said primary area being distinguished from one another by one of a plurality of unique trading symbols printed thereon, each of said trading symbols representing at least one of a plurality of properties;

a plurality of an adapted order forms for a player systematically recording simulated buying and selling transactions using one said forms per trading session; said order form adaptation includes the cooperation of said trading symbols on said gameboard each representing at least one of a plurality of properties and each occupying a separate line on said order form and also providing a designated "purchases" section and a designated "sales" section; said plurality of playing activities conducted during the game include the buying of properties by selectively recording same in the "purchases" section on the line being occupied by the trading symbol representing the selected property and the selling of properties by selectively recording same in the "sales" section on the line being occupied by the trading symbol representing the selected property on said order form;

means for setting value and repeatedly determining a current value related to said trading symbols on said gameboard;

means for simulating a game average indicator having a starting valuation figure and being represented by a predetermined number of said trading symbols on said gameboard; means for determining a valuation change in each of the trading symbols representing the game average indicator in cooperation with said setting value means and the play of the game; means for arriving at a closing figure related to said game average indicator and a total valuation change in the starting valuation figure during the play of the game, including a supply of a game average form and instructions for using same;

a plurality of news cards containing brief amusing messages, fun news, rumors and the like, dividend payment notices and may contain picture indicia; said news cards being placed in a pile face down to be drawn in succession from the top by a player in turn during the play of the game;

a plurality of a designated fun-gram form providing a blank space for a player electing to use said form, in any order, to write/print own play message in the provided space and to give same to any other player; said fun-gram form provided in cooperation with said news cards and the play of the game;

a plurality of championship record sheets for maintaining a record of the highest score achieved by a player to date and the player remaining champion until a higher score is achieved by any player during the play of any succeeding said game;

a plurality of an adapted quotation record form having said trading symbols on said gameboard each occupying a separate line on said record form for the players cooperatively using one said record form per game and systematically recording on each of the trading symbols lines, a starting price, changes in said price occurring during the play of the game pertaining to each of said trading symbols and a closing price being carried over to the succeeding said game;

a plurality of an adapted game score form for a player using one said score form per game enabling the player determining his/her portfolio assets and liabilities value updated to the end of the game recorded thereby and said form also systematically maintaining an updated portfolio holdings number of shares to be carried over to the succeeding said game;

a plurality of an adapted cumulative record form for a player using compilation and accumulation of the recorded data affecting the player's score; said cumulative record form enabling the player determining his/her game paper score updated to the last game played;

instructions for play booklet.

21. The trading game of claim 20 in which said gameboard is capable of hanging on the wall.

22. In a trading game a method of continuing playing comprising the steps of:

recording a player's playing activity and related game data during the play of a game using an adapted conveying instrument systematically carrying the recorded data results over to the succeeding said game; said recording of data includes each one of the elements affecting a player's score being achieved during the play of a plurality of succeeding said game;

updating the recorded data results carried over and combined with similar data being recorded during the succeeding said game using said adapted conveying instrument;

compiling the updated recorded data results being carried over to the succeeding said game systematically using said adapted conveying instrument linking together the completed game with the succeeding said game; said adapted conveying instrument having provisions for systematically recording, updating and compiling pertinent data comprising and affecting a player's score;

thereafter systematically repeating said recording, said updating and said compiling steps establishing a continuous game contest being played over an undetermined period of time by a varying number of players participating in the continuous game contest being established by the plurality of succeeding said game wherein during any of the succeeding games a player, independently from each other player, may score his/her gain or loss achieved during his/her participation in said continuous game contest.

23. In a trading game a method of continuing playing as set forth in claim 22 in which employing a designated conveying instrument cooperatively adapted to function with the game of this invention and providing;

plurality of an adapted order form with means for recording thereon and having pertinent columnar headings and the game trading symbols occupying the first column; said order form being employed by a player, one per turn, systematically recording data related to simulated trading transactions;

plurality of an adapted quotation record form with means for recording thereon and having pertinent columnar headings and the game trading symbols occupying the first column; said quotation record form cooperatively being employed by the players, one per game, systematically recording a starting price, changes in said price and a closing price to be further carried over to the succeeding said game;

plurality of an adapted game score record form with means for recording thereon and having pertinent columnar headings and the game trading symbols occupying the first column; said game score record form, one per game being employed by a player systematically carrying over and updating his/her entire simulated portfolio number of shares at the end of the current game to be further carried over to the succeeding said game; said game score record form also enabling a player determining his/her game assets and liabilities values updated to the current completed game;

plurality of an adapted cumulative record form with means for recording thereon and having pertinent carried over, current and cumulative indicia; said cumulative record form being employed, one per game, by a player systematically recording, updating and compiling game data determining a player's score as of the last game recorded thereon.

24. In a trading game a method of continuing playing as set forth in claim 23 wherein said adapted order form; said adapted quotation record form; said adapted game score form and said adapted cumulative record form in combination containing the elements comprising and affecting a player's score enabling the player carrying over his/her entire portfolio holdings number of shares from the completed game to the succeeding same kind game for continuing playing.

25. In a trading game a method of continuing playing as set forth in claim 24 wherein said adapted order form; said adapted quotation record form; said adapted game score form and said adapted cumulative record form in combination providing means by which a completed game becomes a part of a continuous game contest established by a plurality of succeeding same kind games.

26. In a trading game a method of continuing playing as set forth in claim 25 wherein said adapted order form; said adapted quotation record form; said adapted game score form and said adapted cumulative record form in combination enabling a player to finish his/her game participation and score his/her gain or loss realized in the continuous game contest established by an undetermined plurality of succeeding same kind games.

27. In a trading game a method of continuing playing as set forth in claim 26 wherein said adapted order form; said adapted quotation record form; said adapted game score form and said adapted cumulative record form in combination enabling a "new" player, at any time during any of the plurality of succeeding same kind games to enter and play in the established continuous game contest.

28. In a trading game a method of continuing playing as set forth in claim 27 wherein said adapted order form; said adapted quotation record form; said adapted game score form and said adapted cumulative record form in combination enabling a player, at will, excusing himself/herself temporally from participating in one or more of the plurality of succeeding same kind games and to resume playing at a later succeeding same kind game and having the same portfolio holdings number of shares as of the end of his/her last same kind game played.

* * * * *